US005944177A

United States Patent [19]

Nemoto

[11] Patent Number: 5,944,177

[45] Date of Patent: Aug. 31, 1999

[54] PACKAGING CONTAINER

[75] Inventor: Eiko Nemoto, Kanagawa, Japan

[73] Assignee: Sony Corporation, Tokyo, Japan

[21] Appl. No.: 09/111,404

[22] Filed: Jul. 7, 1998

[30] Foreign Application Priority Data

Jul. 9, 1997 [JP] Japan ..... 9-183711

[51] Int. Cl.[6] ..... B65D 75/54

[52] U.S. Cl. ..... 206/232; 206/468; 206/831

[58] Field of Search ..... 260/232, 461, 260/468, 469, 831

[56] References Cited

U.S. PATENT DOCUMENTS

| | | | |
|---|---|---|---|
| 2,975,889 | 3/1961 | Brown | 206/468 |
| 3,157,280 | 11/1964 | Perdue et al. | 206/468 |
| 3,326,370 | 6/1967 | Riestenberg | 206/468 |
| 3,382,972 | 5/1968 | Phipps | 206/469 |
| 3,939,979 | 2/1976 | Neumayer | 206/468 |
| 4,535,890 | 8/1985 | Artusi | 206/468 |

*Primary Examiner*—Jim Foster
*Attorney, Agent, or Firm*—Jay H. Maioli

[57] ABSTRACT

A packaging container prevents folded margins from becoming loose and prevents a mount from slipping out or the folded margins from hooking each other which might be caused by the loose folded margins. The packaging container comprises a main body having a storage section which is made of a transparent or semi-transparent material and is opened to one direction to store an article to be packaged. The mount covers the opening of the storage section to create a packaging space by inserting a peripheral edge portion of the mount between the folded margins folded over a peripheral edge portion of the main body and the peripheral edge portion. Cuts are made on the peripheral edge portion of the mount to form engaging pieces and the folded margins are inserted partially to the inside of the engaging pieces from the above-mentioned cuts to fix on the side of the main body of the peripheral edge portion of the mount.

5 Claims, 9 Drawing Sheets

PACKAGING CONTAINER

BACKGROUND OF THE INVENTION

The present invention relates to a packaging container or more particularly to a technology for preventing a mount from slipping out of a main body section in a packaging container which comprises the main body having a storage section formed of a transparent material and opened to one direction to store an article to be packaged and the mount for covering the opening of the storage section to hold the article by inserting a peripheral edge portion of the mount between folded margins folded over the peripheral edge portion of the main body and the peripheral edge portion.

Packaging containers for storing various articles such as small items related to audio equipments and household articles and for displaying the stored article for the purpose of sales and the like are available.

FIGS. 1 through 3 show such conventional packaging container a. The packaging container a is composed of a main body section b and a mount c and the main body section b is composed of a storage concave section d and a peripheral edge portion e.

The main body section b is formed to be thin as a whole and the storage concave section d thereof is formed as a rectangular box which is opened to one direction. The peripheral edge portion e which extends to the outside from an opening edge f of the storage concave section d is provided in a body with the storage concave section d as shown in FIGS. 1 through 3.

The main body section b is made of a transparent material or a semi-transparent synthetic resin so that the article stored within the storage concave section d can be seen from the outside.

Folded margins g which are folded back to the inside are formed respectively at longitudinal outer edges of the peripheral edge portion e and at the middle of one short edge as shown in FIGS. 2 and 3.

The mount c has a rectangular shape whose shape and size are almost the same with the outer shape of the peripheral edge portion e and is interposed between the peripheral edge portion e of the main body section b and the folded margins g so that the opening of the storage concave section d is covered completely by the mount c as shown in FIG. 2.

The mount c is freely removable from the main body section b. That is, the mount c is attached to the main body section b by sliding and inserting the both side edges of the mount c along the direction of the long edge between the peripheral edge portion e and the folded margins g from the side of the edge where the folded margins g are not formed and by inserting one edge of the mount c in the direction of the short side between the peripheral edge portion e of the main body section b and the folded margin g in the end. The mount c may be taken out of the main body section b by pulling out the side edge portion of the mount c from the gap between the main body section b and the folded margins g by sliding in the direction opposite from that in inserting it.

By the way, because each of the folded margins g of the main body section b is formed by a processing technology of heating and softening a boarder section thereof with the peripheral edge portion e by an nichrome wire heater and by bending the softened section, they may not be fully bent and become loose more or less by any means. That is, it has had a problem that the gap between the peripheral edge portion e is opened more or less.

Then, there arises a problem that the mount c is liable to slip out when the folded margins g are loose more or less, thus damaging the reliability of the package.

There has been also another problem that the folded margins g of the adjoining packaging containers are liable to hook each other and may be damaged in packing a large number of such packaging containers or taking out a packaging container out of a large number of such packaging containers.

SUMMARY OF THE INVENTION

Accordingly, it is an object of the present invention to prevent folded margins from becoming loose and to prevent a mount from slipping out or the folded margins from hooking each other which may be caused by the loose folded margins.

In order to solve the above-mentioned problems and to achieve the above-mentioned object, according to the present invention, cuts are made on a peripheral edge portion of the mount to form engaging pieces and the folded margins are inserted partially to the inside of the engaging pieces from above-mentioned cuts to fix on the side of the main body of the peripheral edge portion of the mount.

Thereby, it becomes possible to prevent the folded margins from becoming loose.

The specific nature of the invention, as well as other objects, uses and advantages thereof, will clearly appear from the following description and from the accompanying drawings in which like numerals refer to like parts.

DESCRIPTION OF PREFERRED EMBODIMENT

Figure 1:
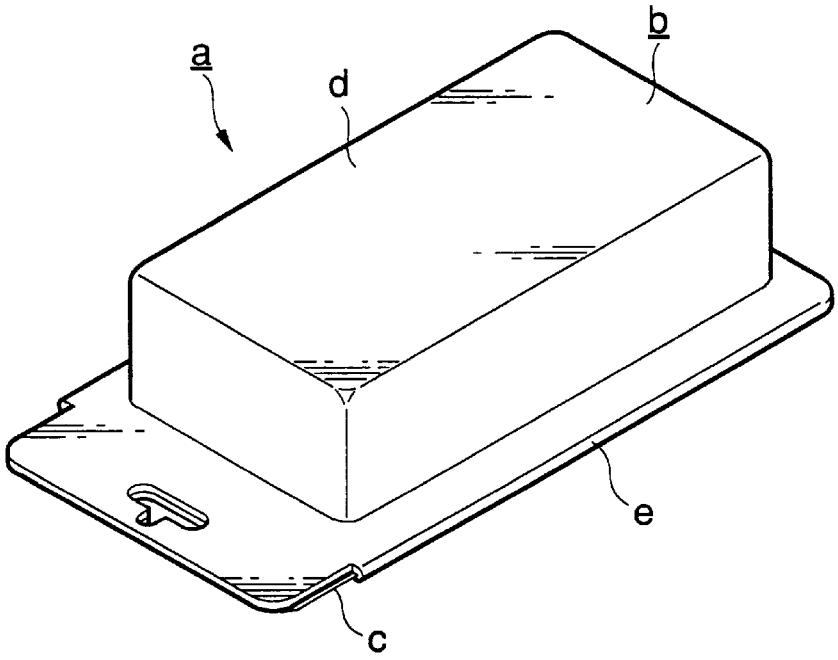
FIG.1 (PRIOR ART)
FIG. 1 is a perspective view showing, together with FIGS. 2 and 3, one example of prior art transparent packaging containers.
Figure 2:
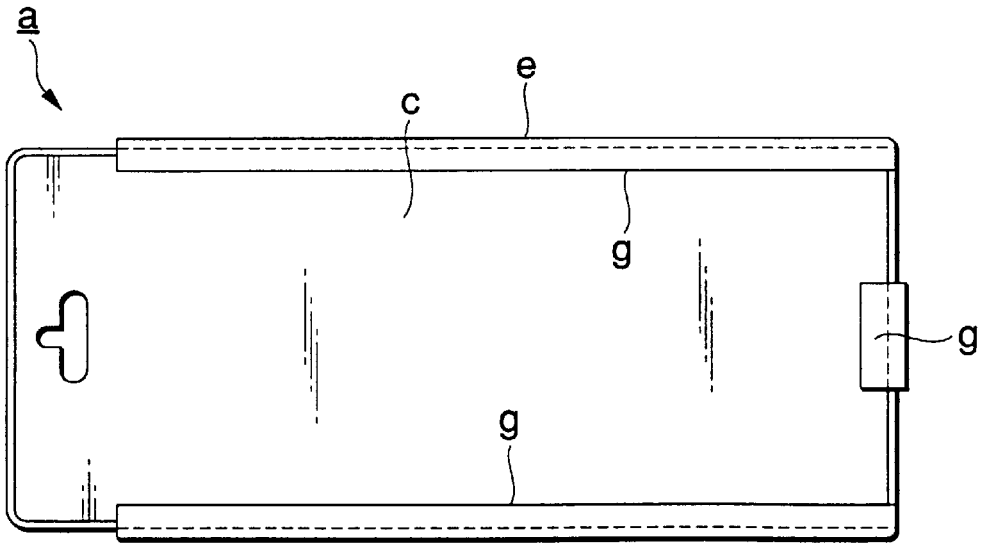
FIG.2 (PRIOR ART)
FIG. 2 is a rear elevation of the prior art packaging container shown in FIG. 1.
Figure 3:
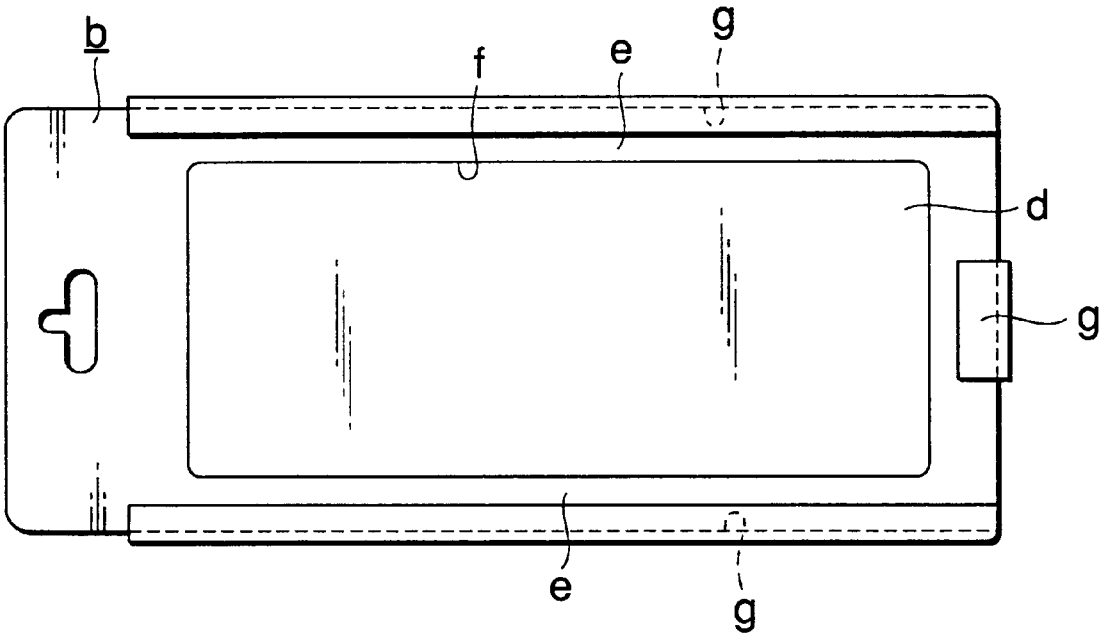
FIG.3 (PRIOR ART)
FIG. 3 is a rear elevation of a main body section of the prior art packaging container.
Figure 4:
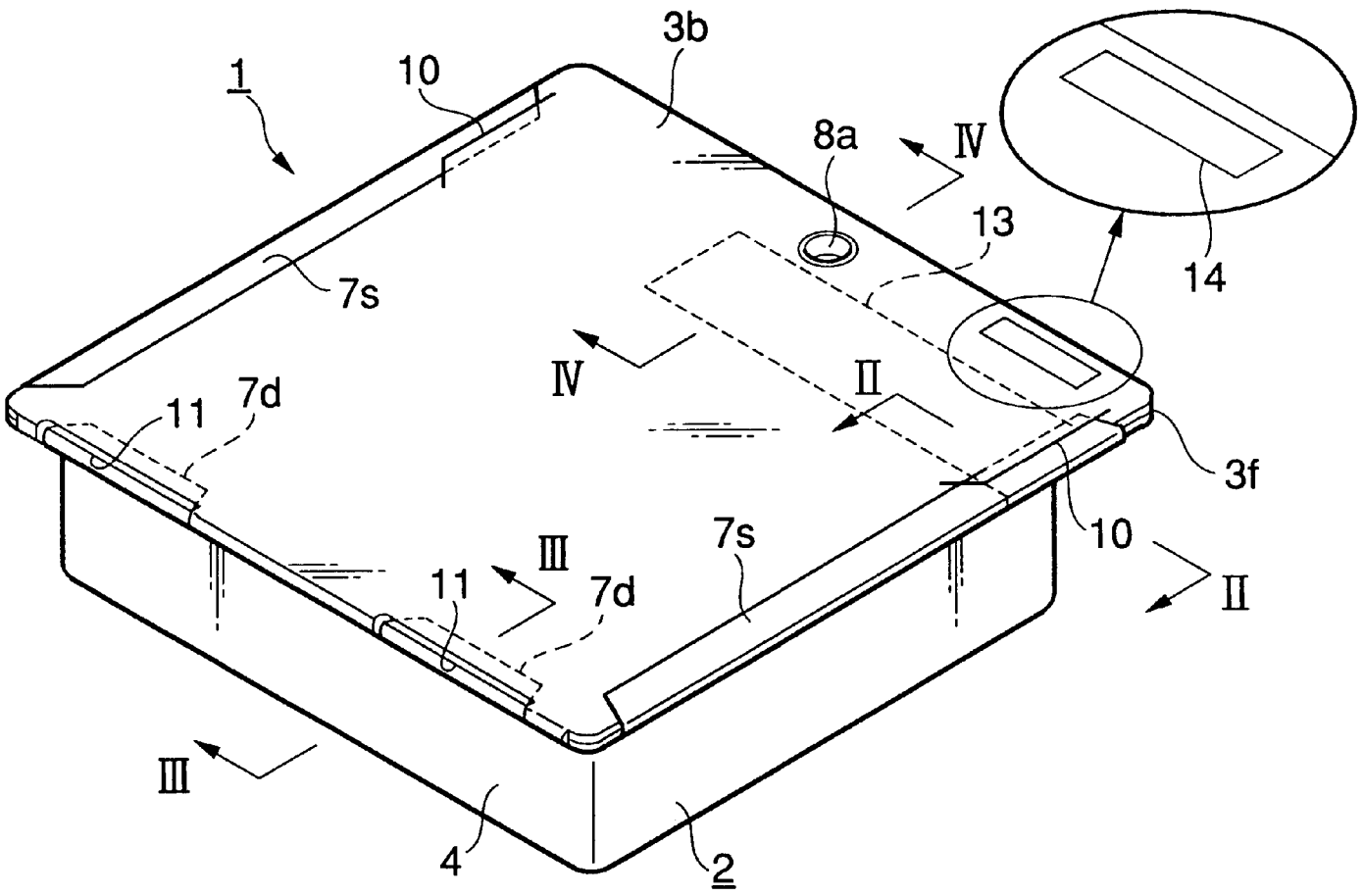
FIG. 4 is a perspective view, seen from the rear side, showing an embodiment of an inventive packaging container, together with FIGS. 5 through 11.
Figure 5:
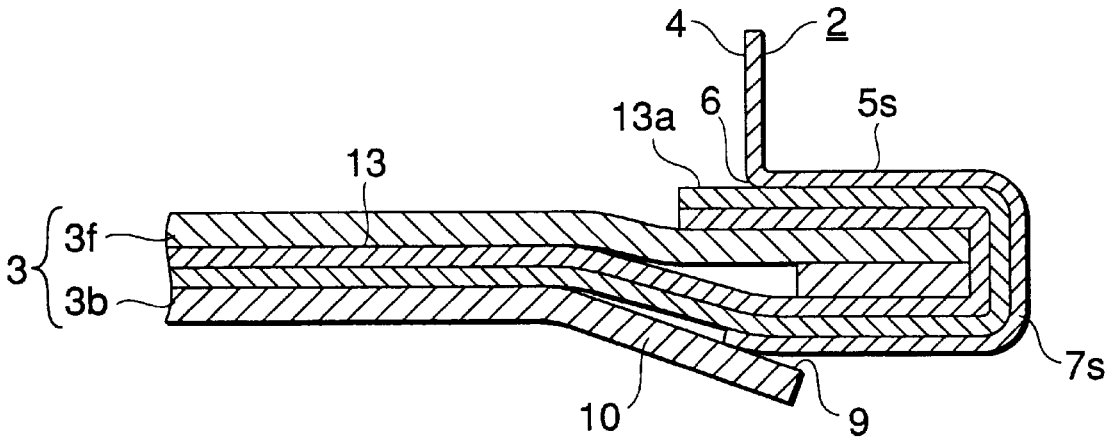
FIG. 5 is an enlarged section view along a line II—II in FIG. 4.
Figure 6:
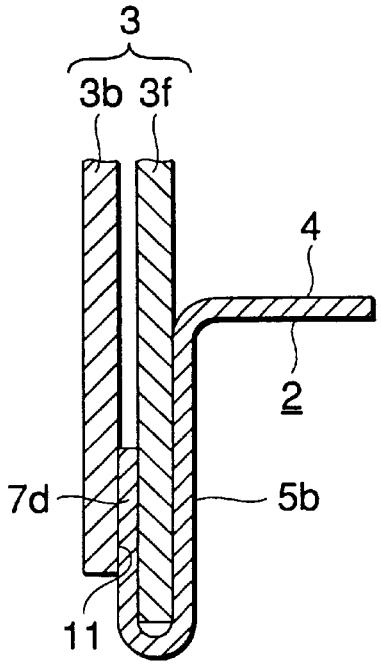
FIG. 6 is an enlarged section view along a line III—III in FIG. 4.

A preferred embodiment of the inventive transparent packaging container will be explained below with reference to the appended drawings.

The packaging container 1 comprises a main body 2 formed of a transparent or semi-transparent synthetic resin sheet such as polyethylene or polyethylene terephthalate and a mount 3 made of hard paper. The main body 2 is composed of a storage concave portion 4 and a peripheral edge portion 5.

The storage concave section 4 is formed into a shape of box having almost a square opening in one direction to store an article to be packaged not shown. It is noted that the storage concave section 4 formed into the square shape in the packaging container 1 is shown in the figure, it may take various shape accommodating to the shape of the article to be stored. The peripheral edge portion 5 which extends to the outside from an opening edge 6 of the storage concave section 4 is provided in a body with the storage concave section 4.

Among four edge portions of the peripheral edge portion 5, folded margins 7*s* and 7*d* are formed at three edge portions except at an upper edge portion 5*u* (the upper right direction in FIG. 4 and FIGS. 8 through 11 will be expressed as the upper direction, the lower left direction as the lower direction, the lower right direction as the right direction, the upper left direction as the left direction, the lower direction as the front and the upper direction as the rear in indicating the directions in the present specification), i.e. at the right and left edge portions 5*s* on the both sides and at the lower edge portion 5*d*, respectively. These folded margins 7*s* and 7*d* are formed by folding back so as to overlap with the rear surface of the peripheral edge portion 5 from the outer edge of the peripheral edge portion 5. In concrete, the folded margins are formed by heating and softening projecting pieces which have been formed in advance continuously to the outer edge of the peripheral edge portion 5 and which turn out to be the folded margins by an nichrome wire heater at the boarder part thereof with the peripheral edge portion 5 and by bending the softened part after removing the heater. It is noted that each of the folded margins 7*s* and 7*d* are formed into a trapezoidal shape so that the farther to the edge thereof, the narrower the width thereof becomes.

Figure 7:
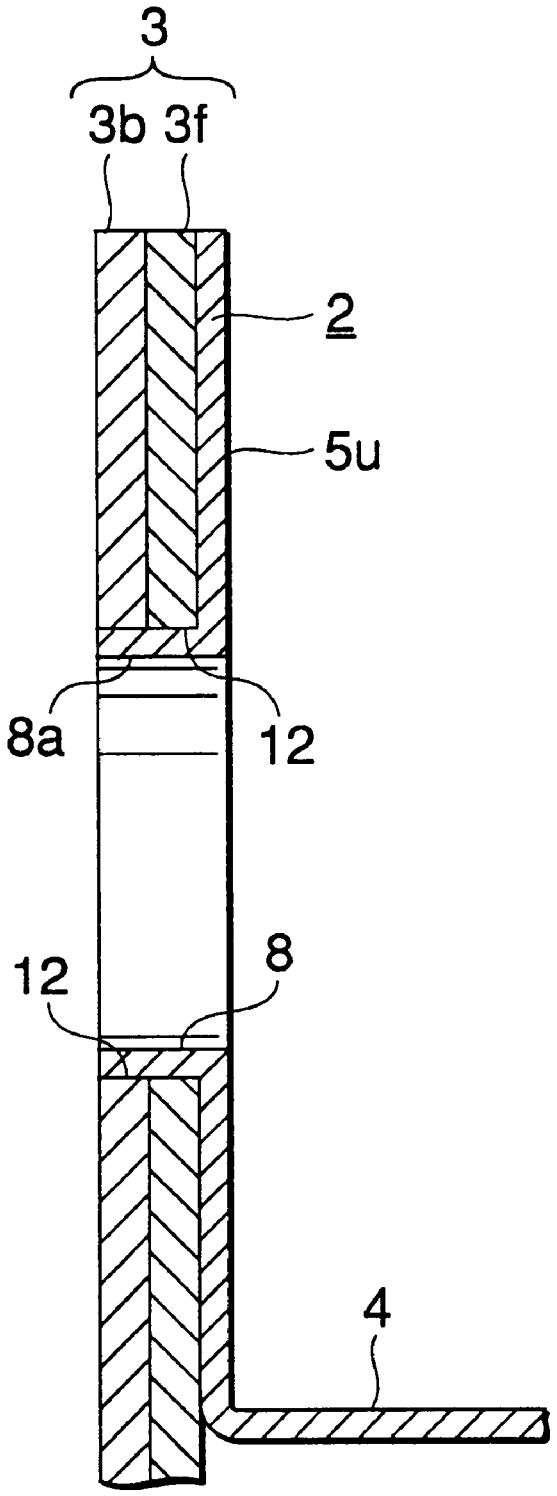
FIG. 7 is an enlarged section view along a line IV—IV in FIG. 4.
Figure 8:
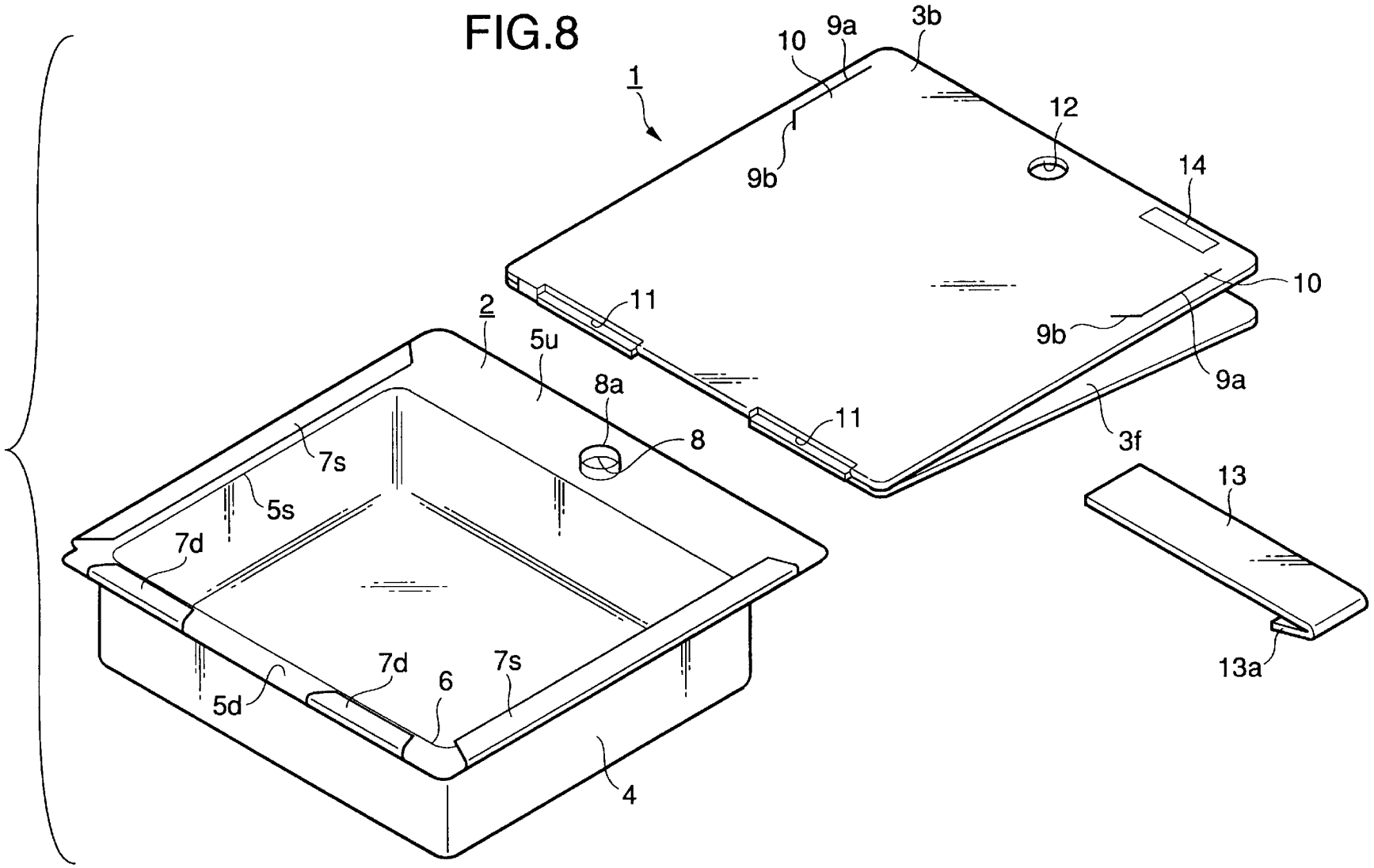
FIG. 8 is an exploded perspective view of the packaging container showing FIG. 4.
Figure 9:
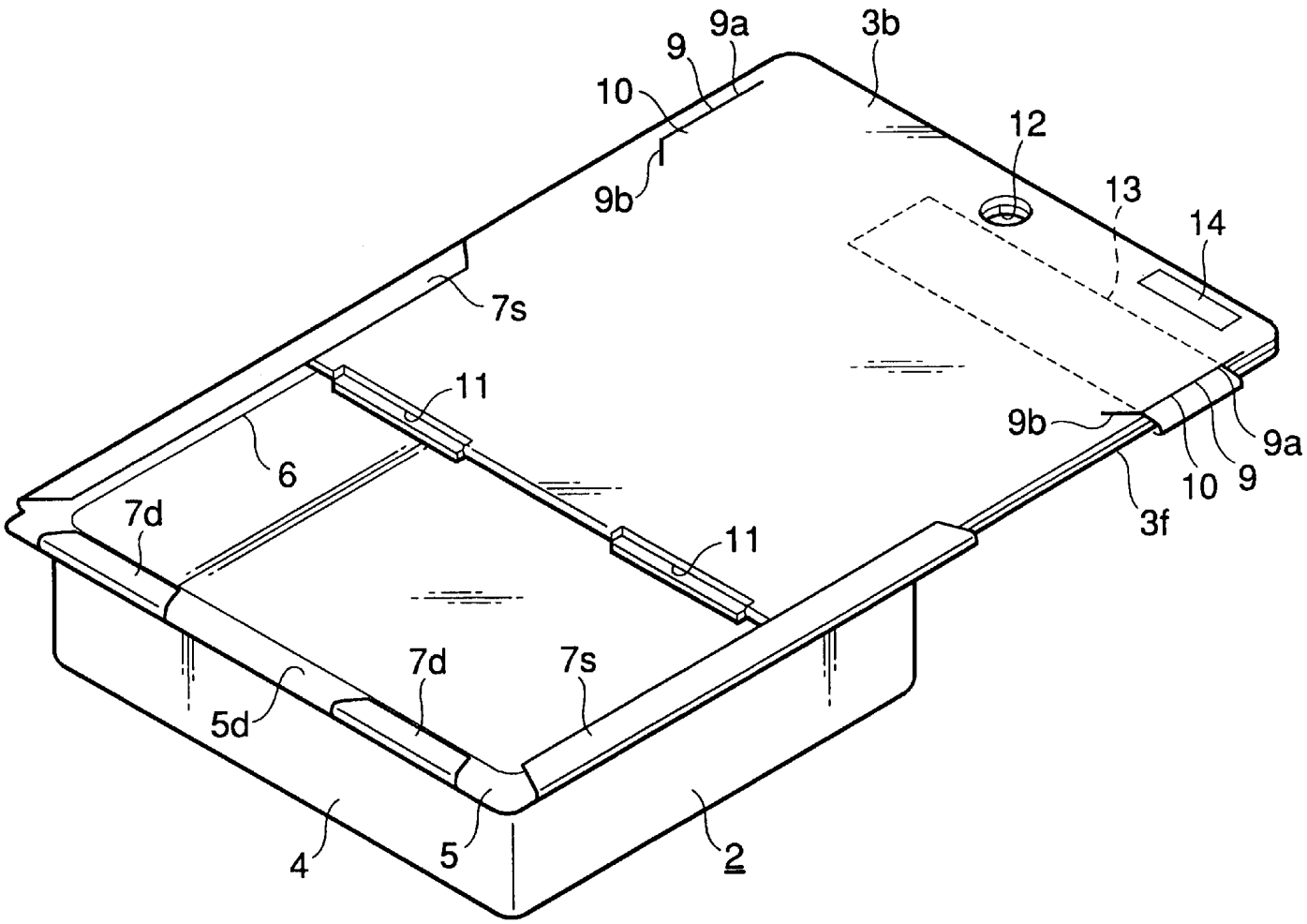
FIG. 9 is a perspective view showing, together with FIGS. 10 and 11, an initial state of a procedure for coupling the main body with the mount.
Figure 10:
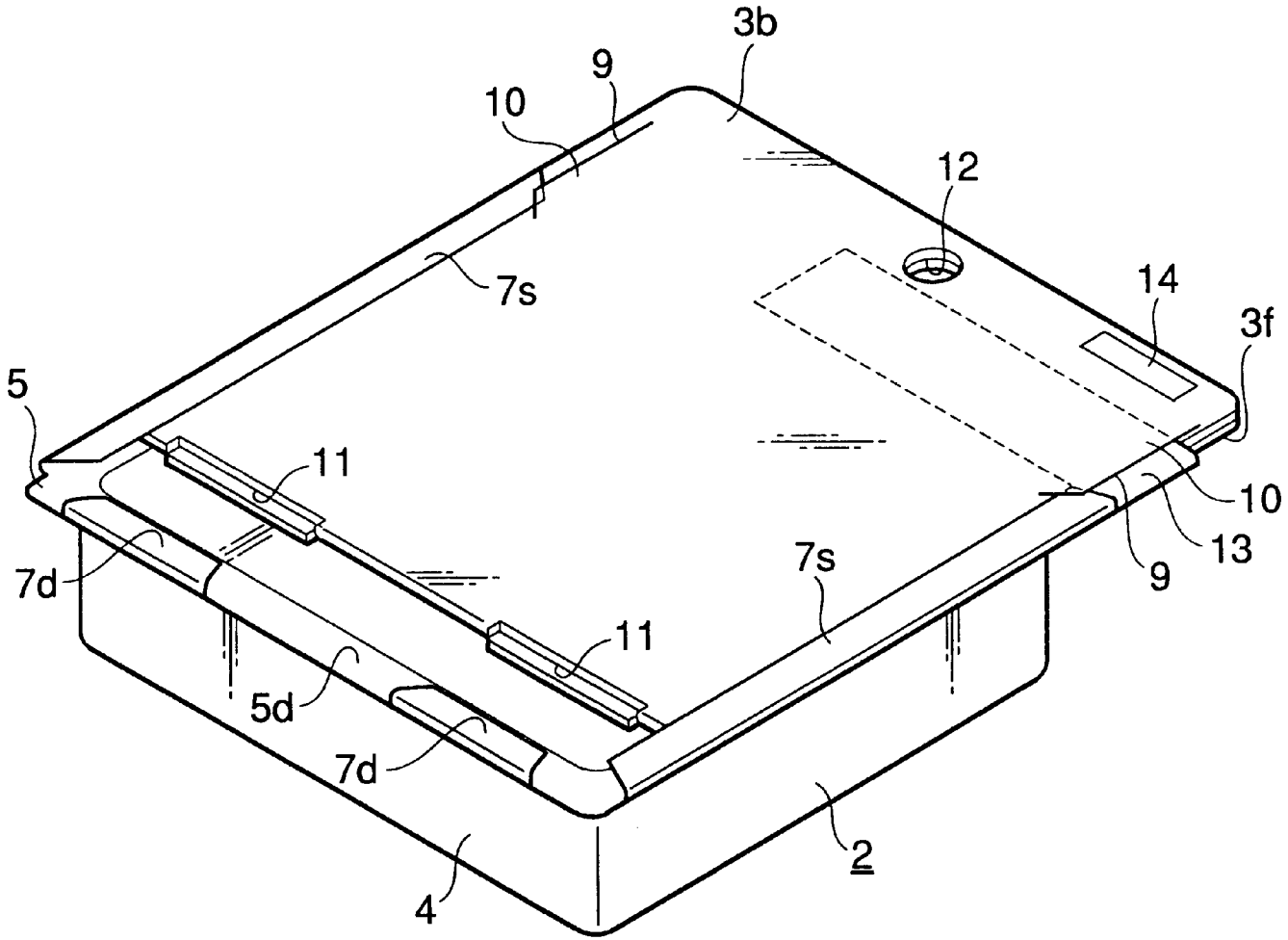
FIG. 10 is a perspective view showing a state in which folded margins of the side edge portion are started to be inserted to the inside of engaging pieces.
Figure 11:
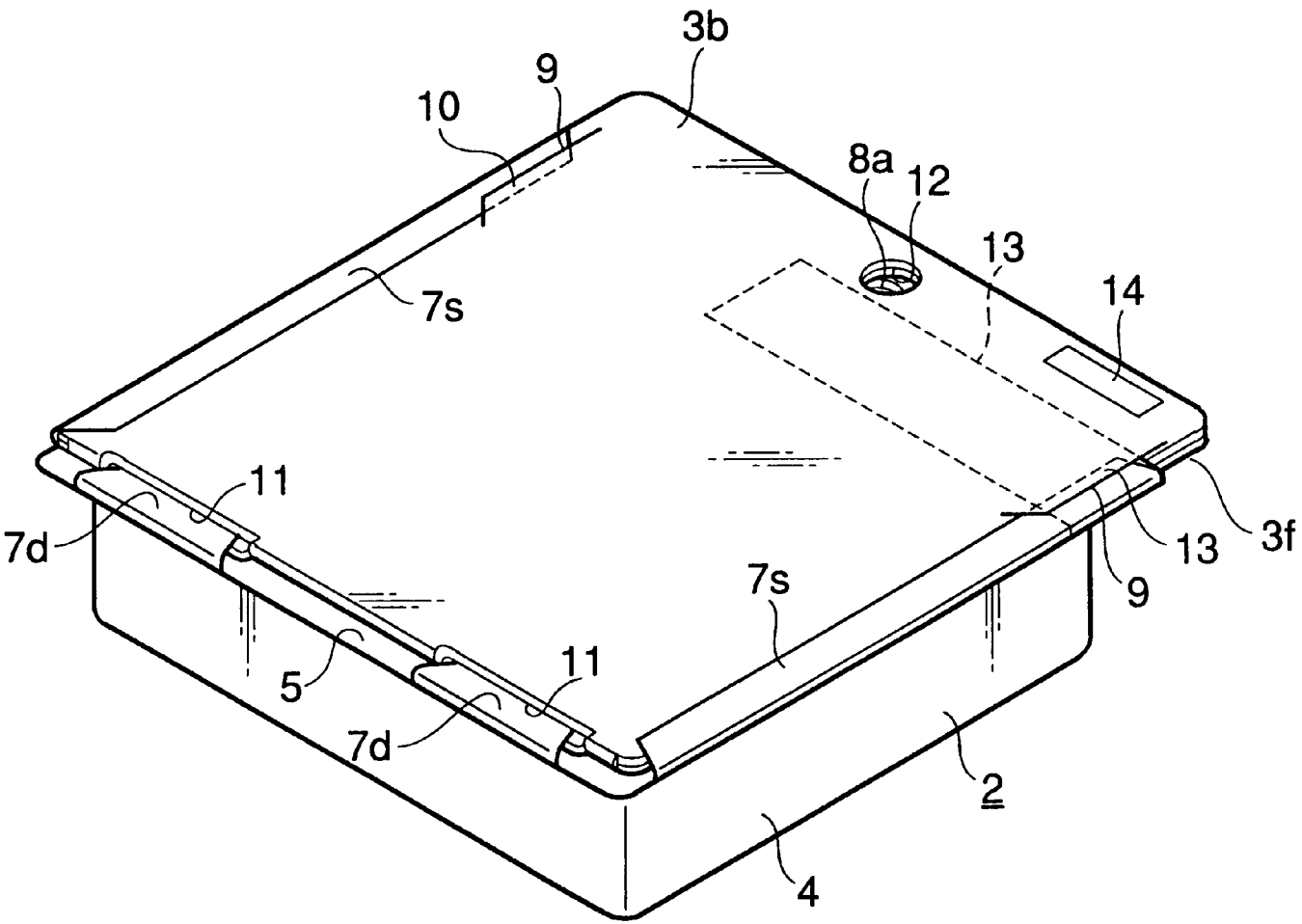
FIG. 11 is a perspective view showing a state in which the folded margins at the lower edge are started to be inserted between two mount members.

A suspension hole 8 for suspending the packaging container as well as a fitting cylinder 8*a* which projects in the rear direction across the whole circumference of an opening edge of the suspension hole 8 are created almost at the middle of the upper edge portion 5*u* of the peripheral edge portion 5 as shown in FIG. 7.

The mount 3 is formed by piling up two mount members. In concrete, the mount 3 is composed of a front mount member 3*f* and a back mount member 3*b* which are obtained by doubling one mount sheet member. The mount members 3*f* and 3*b* have the shape almost the same with the outer shape of the peripheral edge portion 5. Then, cuts 9 are made from the position a little to the upper direction from the middle of the both edge portions of the back mount member 3*b* to the vicinity of the upper edge thereof.

Each of the cuts 9 is composed of a vertical part 9*a* which extends vertically along the side edge of the back mount member 3*b* and a lower part 9*b* which extends obliquely from the lower end of the part 9*a* to the inside, i.e. to the lower left direction in the right cut 9 and to the lower right direction in the left cut 9. Such cuts 9 form engaging pieces 10.

Further, cuts 11 are made at a join section at the lower edges of the mount members 3*f* and 3*b*. Still more, suspension holes 12 having almost the same shape with the suspension hole 8 created through the main body 2 are created at the upper edge portion of the mount members 3*f* and 3*b*.

Then, the main body 2 is coupled with the mount 3 as described below. The both right and left edge portions of the mount 3 are slid and inserted between side piece portions 5*s* of the peripheral edge portion 5 and the folded margins 7*s* formed at that portion from the upper direction of the main body 2 while storing an article to be packaged in the storage concave section 4 of the main body 2. Then, the folded margins 7*s* are inserted between the engaging pieces 10 and the mount member 3*f* from the lower parts 9*b* of the cuts 9 of the back mount member 3*b*. Finally, the folded margins 7*d* at the lower edge portion 5*d* are inserted between the two mount members 3*f* and 3*b* from the insertion cuts 11 and the fitting piece 8*a* formed at the opening edge of the suspension hole 8 of the main body 2 is fitted into the suspension holes 12 of the mount members 3*f* and 3*b*.

The packaging container 1 is built by coupling the main body 2 and the mount 3 as described above. Because the folded margins 7*s* formed at the side edge portions 5*s* are positioned at the front side of the engaging pieces 10 of the back mount member 3*b* and the folded margins 7*d* formed at the lower edge portion 5*d* are positioned while being interposed between the two mount members in the packaging container 1 built as described above, the folded margins 7*s* and 7*d* will not become loose with respect to the peripheral edge portion 5. Therefore, the problems caused by the looseness of the folded margins with respect to the peripheral edge portion, i.e. the problems of that the mount is liable to slip out of the main body and the reliability of the package is damaged and that the folded margins of adjoining packaging containers hook each other and the folded margins are damaged in packing a large number of such packaging containers or in taking a packaging container out of a large number of such packaging containers, may be eliminated.

A guarantee 13 on the article to be packaged by the packaging container 1 is folded to a size which allows to be inserted from the cut 9 and is inserted between the folded margin 7*s* inserted to the inside of the engaging piece 10 and the engaging piece 10 from the cut 9 and one end 13*a* thereof is folded to the front side to position between the mount members 3*f* and 3*b* from the side edge of the mount member 3*b*. Then, a notice 14 informing of that the guarantee is contained inside, e. g. characters of "GUARANTEE", is given in the vicinity of the part where the guarantee 13 is inserted and the engaging piece 10 is located on the back of the mount member 3*b*.

Accordingly, it allows date of sales to be written or to be stamped on the guarantee in a shop without unpacking the package, thus simplifying the process for handling the guarantee in the shop. It is noted that the notice informing that the guarantee is contained inside given at the above-mentioned location may be given directly on the guarantee, not on the back of the mount member 3*b*, or may be given in the vicinity of the location where the one end 13*a* of the guarantee 13 is located in the folded margin 7*s* of the main body 2. In short, the notice is given so that the guarantee 13 can be found right away in the shop.

Further, because the fitting piece 8*a* formed around the opening edge of the suspension hole 8 created through the main body 2 is fitted into the suspension holes 12 created through the mount members 3*f* and 3*b* in the packaging container 1 described above, it allows to prevent the mount members 3*f* and 3*b* from slipping out of the main body 2 just by itself and requires no means to be taken, i.e. it does not require to staple the main body and the mount for example.

It is noted that although the mount is doubled in the packaging container 1 described above, the mount may be singular. However, the folded margins are positioned while being interposed between the two mount members, thus stabilizing the position of the folded margins, and the folded margins are seen from the front side, thus improving the look, by doubling the mount.

Further, not only one obtained by doubling one sheet member as described in the above-mentioned embodiment, but also one obtained by superposing two mount members formed of different sheet members may be used in obtaining the twofold mount. However, it is preferable to form the twofold mount by doubling one sheet member and to create the cuts 11 for inserting the folded margins 7*d* between the two mount members 3*f* and 3*b* at the join section thereof in order to prevent the folded margins 7*d* formed at the lower edge portion 5*d* from becoming loose.

As it is apparent from the description above, the inventive packaging container comprises the main body having the storage section which is opened to one direction to store the article to be packaged and the mount for covering the opening of the storage section to create a packaging space by inserting the peripheral edge portion of the mount between the folded margins folded over the peripheral edge portion of the main body and the peripheral edge portion. It is characterized in that the cuts are made on the peripheral edge portion of the mount to form the engaging pieces and the folded margins are inserted partially to the inside of the engaging pieces from the above-mentioned cuts to fix at the peripheral edge portion of the mount on the side of the main body.

Accordingly, it is possible to prevent the folded margins from becoming loose. Therefore, the problems caused by the looseness of the folded margins with respect to the peripheral edge portion, i.e. the problems of that the mount is liable to slip out of the main body and the reliability of the package is damaged and that the folded margins of adjoining packaging containers hook each other and the folded margins are damaged in packing a large number of packaging containers or in taking a packaging container out of a large number of packaging containers, may be eliminated. Thereby, the reliability of the package may be enhanced.

Because the mount is created by twofold mount members with one of twofold mount member facing to the storage concave section and the engaging pieces being created on the other mount member, the folded margins are fixed while being interposed between the two mount members, thus stabilizing the position of the folded margins, and the folded margins are not seen from the front side, thus improving the look.

Further, because the folded margins are formed at the three edges, except at one edge, among the four edges of the peripheral edge portion of the main body, the folded margins formed at the two edges adjacent to one edge where the folded margin is not formed are inserted to the cuts made on the mount and at least part of the folded margins formed on the remaining one edge among the three edges are fixed, at least partially, so as to be interposed between the two mount members. It is possible to prevent the folded margins from becoming loose at the edges where the folded margins are formed, thus enhancing the reliability of the package.

Still more, because the guarantee on the article to be packaged is inserted between the two mount members from the gap between the folded margin inserted to and engaged with the engaging piece and the engaging piece and part of the guarantee is fixed at the folded margin side of the other mount member, the guarantee may be taken out readily, thus facilitating the work for writing or stamping on the guarantee in the shop.

It is noted that all of the shape and structure of each part shown in the embodiment described above are a mere illustration of the embodiment in carrying out the invention and the technological scope of the invention should not be construed to be limited by them.

What is claimed is:

1. A packaging container, comprising:

a main body including a storage section formed of one of a transparent material and semi-transparent material and opened to one direction for storing an article; and a mount for covering an opening of said storage section for holding said article by inserting a peripheral edge portion of said mount between a plurality of folded margins formed by folding over respective peripheral edge portions of said main body, wherein a plurality of cuts are provided on said peripheral edge portion of said mount for forming a plurality of engaging pieces for engaging said plurality of folded margins partially with said plurality of engaging pieces.

2. The packaging container as set forth in claim 1, wherein said mount is formed of a twofold mount member, one mount member of said twofold mount member faces a concave section of said storage section, and said plurality of engaging pieces are located on the other mount member of said twofold mount member.

3. The packaging container as set forth in claim 2, wherein said plurality of folded margins are formed at three edges among four edges of said peripheral edge portion of said main body, said plurality of folded margins formed at two edges of said three edges and adjacent to an edge where said plurality of folded margins are not formed are inserted in said plurality of cuts made on said mount, and said plurality of folded margins formed at an edge among said three edges and opposite to said edge where said plurality of folded margins are not formed are fixed, at least partially, so as to be interposed between said one mount member and said other mount member.

4. The packaging container as set forth in claim 2, wherein a guarantee on said article to be packaged is inserted between said one mount member and said other mount member at a gap between said plurality of folded margins inserted in and engaged with one of said plurality of engaging pieces and said one of said plurality of engaging pieces, and a part of said guarantee is fixed at a folded margin side of said other mount member.

5. The packaging container as set forth in claim 4, wherein a notice that said guarantee is contained in said main body is given in a vicinity of a region where said one of said plurality of engaging pieces is located and said guarantee is inserted.

* * * * *